US007258336B2

(12) United States Patent
Moore et al.

(10) Patent No.: US 7,258,336 B2
(45) Date of Patent: Aug. 21, 2007

(54) INTEGRATED VACUUM SLIDE FEEDER

(75) Inventors: Kenneth P. Moore, Rochester, NY (US); Brian R. Ford, Walworth, NY (US); Timothy G. Shelhart, West Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 46 days.

(21) Appl. No.: 11/230,961

(22) Filed: Sep. 20, 2005

(65) Prior Publication Data

US 2007/0063418 A1 Mar. 22, 2007

(51) Int. Cl.
*B65H 3/08* (2006.01)

(52) U.S. Cl. ..... 271/108; 271/11; 271/10.02; 271/107; 271/31; 271/30.1

(58) Field of Classification Search ..... 271/11, 271/10.02, 107–108, 31, 30.1, 98
See application file for complete search history.

(56) References Cited

U.S. PATENT DOCUMENTS 3,334,896 A * 8/1967 Mullin ..... 271/108
3,659,839 A * 5/1972 Baucke ..... 271/183
3,684,277 A * 8/1972 Buschmann ..... 271/183
4,106,765 A * 8/1978 Britt et al. ..... 271/93
4,236,707 A * 12/1980 Fujimoto ..... 271/11
4,627,606 A 12/1986 Moore
5,707,056 A * 1/1998 Rauen et al. ..... 271/96
6,279,896 B1 * 8/2001 Linder et al. ..... 271/98
6,609,708 B2 * 8/2003 Moore et al. ..... 271/98

* cited by examiner

*Primary Examiner*—Patrick MacKey
*Assistant Examiner*—Gerald W McClain
(74) *Attorney, Agent, or Firm*—Maginot, Moore & Beck

(57) ABSTRACT

A sheet feeder assembly for acquiring and conveying a sheet comprises a plenum connectable to a vacuum source and having an opening facing the sheet to be conveyed, and a slide plate covering the opening. The slide plate has an acquisition surface facing the sheet to be conveyed and defining apertures in communication with the plenum. A drive mechanism is connected to the slide plate and supported within the plenum, and is operable to translate the slide plate relative to the plenum to convey the acquired sheet while maintaining the vacuum through the apertures. The drive mechanism includes a motor and eccentrically driven link connected to a carriage supporting the slide plate. The motor is coupled to a cam element that drives a flapper valve disposed between the plenum and a vacuum duct. The cam element also drives a height sensing arm supported to contact the top of the stack.

24 Claims, 13 Drawing Sheets

INTEGRATED VACUUM SLIDE FEEDER

BACKGROUND

This disclosure relates generally to a sheet feeder for use in a printing machine, such as an electrophotographic reproduction machine. More particularly the disclosure concerns a vacuum corrugation feeder for removing sheets from a stack and transferring the sheets.

In one type of electrophotographic printing or reproduction machine, such as the machine M shown in FIG. 1, a photoconductive member or belt 10 is charged by a corona generating device 12 at a station A to a substantially uniform potential so as to sensitize the surface thereof. At a station B, the charged portion of the photoconductive member 10 is exposed to a light image of an original document being reproduced obtained from a scanning device, such as a raster output scanner 14. Exposure of the charged photoconductive member selectively dissipates the charges thereon in the irradiated areas which records an electrostatic latent image on the photoconductive member corresponding to the informational areas contained within the original document.

After the electrostatic latent image is recorded on the photoconductive member, the latent image is developed by bringing a developer material into contact therewith at a series of developer stations C and D. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. For a typical black and white electro-photographic printing machine, a single development station C may be provided. On the other hand, with the advent of multicolor electrophotography, multiple additional development stations D may be provided that fix color toner to the photoconductive member 10.

Subsequent to image development, a sheet S of support material is moved into contact with the toner images at a transfer station G. At this station, a transfer dicorotron 16 sprays positive ions onto the backside of the sheet S which attracts the negatively charged toner particle images from the photoreceptor 10 to the sheet S. A detack corotron 18 is provided for facilitating stripping of the sheet S from the surface of the photoreceptor. After transfer, the sheet S travels to a fusing station H where a heated fuser roller assembly 20 permanently affixes the toner powder to the sheet S.

It is desirable in high speed color printers such as those described above to be able to feed a wide variety of sheet types for various printing jobs. Customers demand multiple sized stock, a wide range of paper weights, paper appearance characteristics ranging from rough flat appearing sheets to very high gloss coated paper stock. Each of these sheet types and size has its own unique characteristics and in many instances very different problems associated therewith to accomplish high speed feeding.

There is shown in FIG. 2, a side elevational schematic view of a high speed sheet feeder, generally indicated by reference numeral 200. The basic components of the feeder 200 include a sheet support tray 210, which may be tiltable and self adjusting to accommodate various sheet types and characteristics; multiple tray elevator mechanisms 220, 230; a vacuum shuttle feedhead 300; a lead edge multiple range sheet height sensor 340; a multiple position stack height sensor 350; a variable acceleration take away roll (TAR) 400; inboard and outboard sheet fluffers 360, and trail edge fluffer 362.

The feedhead is a top vacuum corrugation feeder (VCF), so distance control of the top sheets in the stack T from the acquisition surface 302 and the fluffer jets 360 and 362 are very important. The acquisition surface 302 is the functional surface on the feed head 300 or vacuum plenum. The two sensors 340, 350 together enable the paper supply to position the stack T. The multi-position stack height sensor 350 contacts the sheet stack T to detect two or more specific stack heights. This sensor 350 works in conjunction with the second sensor 340 near the stack lead edge which also senses the distance to the top sheet, but without sheet contact. The two sensors together enable the paper supply to position the stack T with respect to an acquisition surface 302 of the feedhead 300, both vertically and angularly in the process direction. This height and attitude control greatly improves the capability of the feeder to cope with a wide range of paper basis weight, type, and curl.

The paper feeder 300 acquires individual sheets S of paper (using air pressure) from the top of a stack T and transports them forward to the TAR 400. Among the independent variables in the paper feeder design are three sets of air pressures, including air knife pressure and fluffer pressures that supply air for sheet separation and vacuum pressure which cause sheets to be acquired by the shuttle feed head assembly. Each set of pressures is supplied from one combination blower. As fluffer pressure increases the sheets on the top of the stack become more separated with the top most sheets being lifted closer to the vacuum feed head. As the fluffing pressure gets higher, the risk of more than one sheet being moved into the take-away nip, when the feed head moves increases also, (a.k.a. multifeed). As the fluffing pressure gets lower, the risk of the top sheet not getting close enough to the feed head (and thus not becoming acquired by the vacuum present on the bottom of the feed head) increases which can result in no sheet being fed when the feed head moves forward, (a.k.a., misfeed or late acquisition). The optimum amounts of fluffer and vacuum feed-head pressures are a function of the size and weight of the sheets (larger, heavier sheets requiring more fluffing and vacuum and visa-versa for smaller, lighter sheets).

During each sheet feed, when the trailing edge of the sheet passes the stack height arm 352 (FIG. 3), the arm compresses the stack T, the stack height sensors 340, 350 measure the position of the solid stack, and the stack height arm 352 is raised again after about 25 ms. The timing of the movement of the arm is controlled by a cam 348 that is driven by a stepper motor 310. Once the trailing edge of the sheet S passes the position of the lead edge sensor 340, the position of the leading edge of the fluffed stack T is measured. The values of these measurements are then compared to the desired states for the paper being fed and the tray is adjusted accordingly. The fluffer jets 360, 362 remain activated during these steps The feedhead 300 is a top vacuum corrugation feeder which incorporates an injection molded plenum/feed head 301 with a sheet acquisition and corrugation surface 302, as shown in FIG. 3. The feed head 300 is optimally supported at each corner by a ball bearing or other low friction roller/track assembly 304. In a typical installation, the feed head 300 is driven forward twenty mm and returned twenty mm back its home position by a continuous rotation and direction twin slider-crank drive 346 mounted on the double shaft stepper motor 310. This includes five mm over-travel to account for paper loading tolerance and misregistration. This drive results in a linear sheet speed of about 420 mm/s as the sheet is handed off to the take away roll 400 (TAR). The TAR 400 may also be stepper driven to accelerate the sheet S up to transport speed. The feed head 300 supports each sheet fully as it is carried to the TAR 400. This approach avoids a "pushing on rope" syndrome that plagued earlier systems.

Thus, the prior sheet feed apparatus 300 includes a vacuum source, the vacuum source being selectively actuatable to acquire and release a top sheet from a stack; a feedhead, attached to the vacuum source to acquire the top sheet of the stack; and a unidirectional drive mechanism, the drive mechanism being driven in a single direction while causing the feedhead to reciprocate from a first position to a second position. Additionally, the sheet feed apparatus can include a stack height sensor actuator coupled to the unidirectional drive mechanism and a stack height sensor attached to the stack height sensor actuator so that the stack height sensor contacts and disengages the sheet stack at a preselected time coordinated with the reciprocating motion of the feedhead. Moreover, the stack height sensor actuator can comprise a cam member, attached to the unidirectional drive mechanism and rotating therewith; a biasing member; a cam follower, attached to the biasing member and biased into contact with said cam and attached to said stack height sensor to control the movement of said stack height sensor. Furthermore, the sheet feed apparatus can include a unidirectional drive mechanism which comprises a stepper motor operating in a unidirectional rotational mode.

In these prior feeder mechanisms, the entire sheet feed apparatus 300 is propelled by the motor 310. Thus, the motor must be powerful enough to accurately and precisely move the apparatus 10 in order to transport a single sheet to the TAR 400. The more powerful motor is more expensive, generates more heat and requires more energy to operate. Moreover, driving the entire sheet feeder mechanism imposes a limit on feed speed, due to the inertia of the mechanism 300, and increases the risk of skewing of the acquisition surface 302 and ultimately of the sheet S as it is received by the TAR. There is a need for a vacuum sheet feeder apparatus that eliminates these problems.

SUMMARY

In order to address the needs, a sheet feeder assembly for acquiring and conveying a sheet is provided that comprises, in certain embodiments, a plenum connectable to a vacuum source and having an opening facing the sheet to be conveyed, and a slide plate covering the opening. The slide plate has an acquisition surface facing the sheet to be conveyed and defines a plurality of apertures in communication with the plenum through which vacuum is drawn to acquire the sheet. A drive mechanism is connected to the slide plate and supported within the plenum, and is operable to translate the slide plate relative to the plenum to convey the sheet acquired thereby.

In a further embodiment, a sheet feeder assembly for acquiring and conveying a sheet is disclosed that comprises a vacuum duct connectable to a vacuum source, and a plenum connected to the vacuum duct and having an opening facing the sheet to be conveyed. A motor is supported within the plenum. A plate movably covers the opening in the plenum and has an acquisition surface facing the sheet to be conveyed that defines a plurality of apertures in communication with the plenum through which vacuum is drawn to acquire the sheet. A valve is disposed between the duct and the plenum, and is movable between an open position in which the duct is open to the plenum, and a closed position in which the duct is closed to the plenum. The assembly further comprises a height sensing arm movably supported relative to the plenum, the height sensing arm having a sensing end arranged to contact the sheet in a contact position. In accordance with this embodiment, the plate, the valve and the height sensing arm are operably coupled to the motor within the plenum so that operation of the motor moves each of the plate, the valve and the height sensing arm.

In yet another embodiment, a printing machine comprises an imaging station for obtaining an image, a transfer station for transferring the image onto a sheet, a support tray for support a stack of sheets, and a transport system for transporting a sheet from the stack to the transfer station. The transport system comprises a top vacuum corrugation feeder assembly (TVCF) including a plenum connectable to a vacuum source and having an opening facing the stack on the support tray and a slide plate covering the opening. The slide plate has an acquisition surface facing the stack on the support tray and defining a plurality of apertures in communication with the plenum through which vacuum is drawn to acquire a sheet from the stack. The TVCF further includes a drive mechanism connected to the slide plate and supported within the plenum. The drive mechanism is operable to translate the slide plate relative to the plenum to convey the sheet acquired thereby.

DESCRIPTION OF THE EMBODIMENTS

Figure 1:
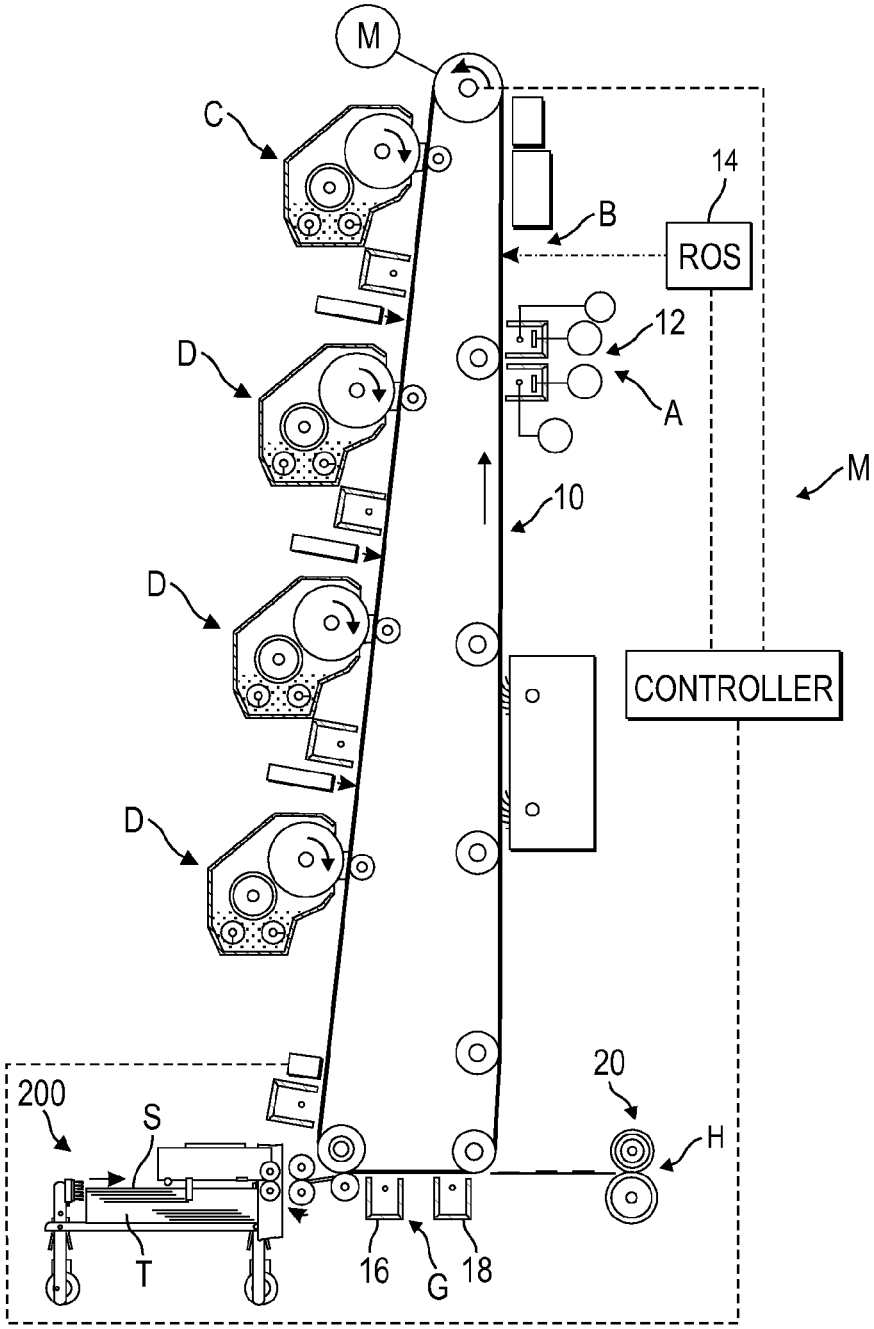
FIG. 1 PRIOR ART
FIG. 1 is a schematic elevational view of a full color image-on-image single-pass electrophotographic printing machine.
Figure 2:
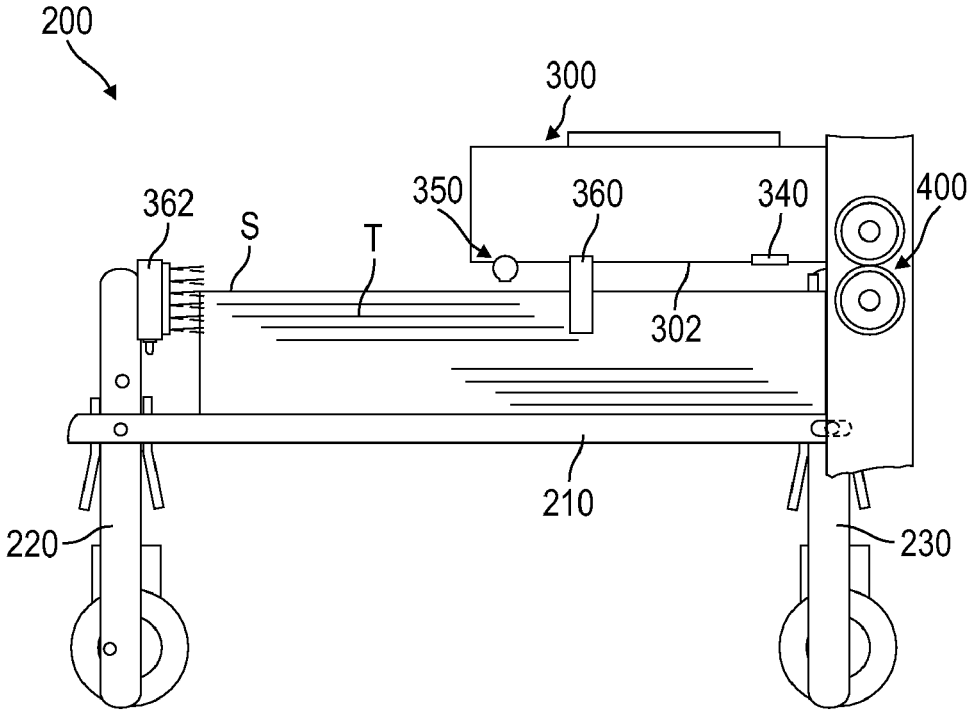
FIG. 2 PRIOR ART
FIG. 2 is a side elevational view of a known sheet feeder apparatus incorporated into the machine shown in FIG. 1.
Figure 3:
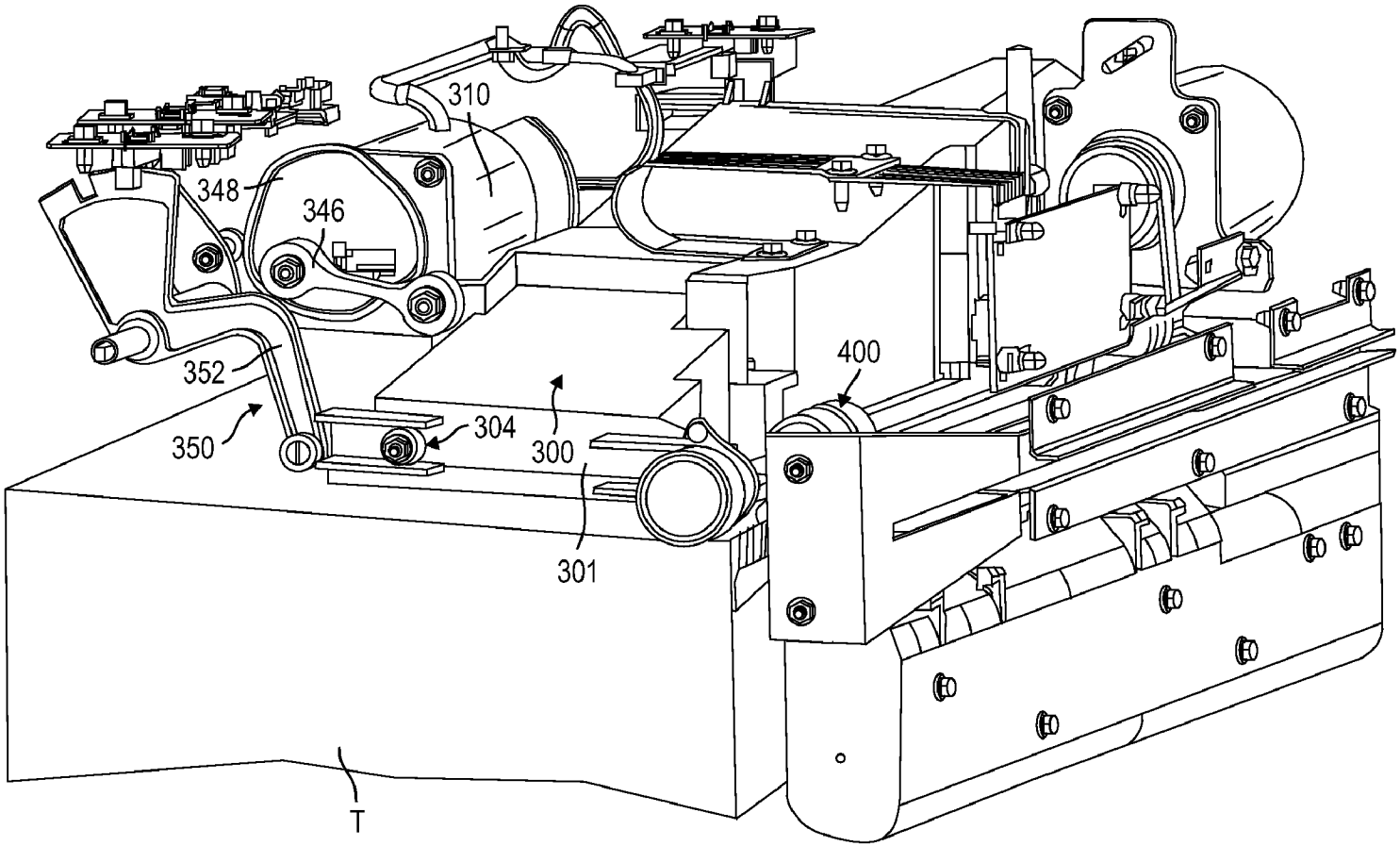
FIG. 3 PRIOR ART
FIG. 3 is a perspective view of the sheet feeder apparatus shown in FIG. 2.
Figure 4:
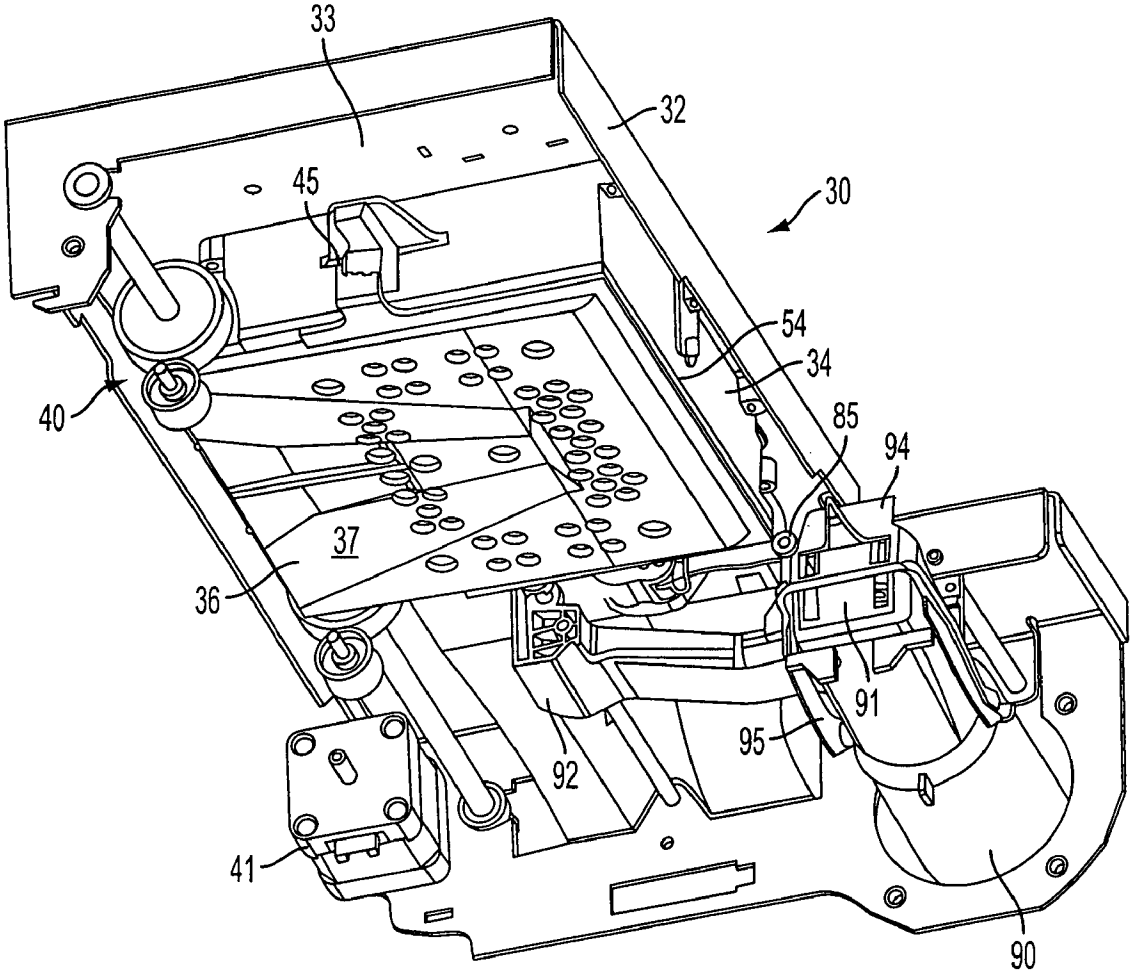
FIG. 4 is a bottom perspective view of one embodiment of a sheet feeder assembly apparatus of the present disclosure.

The present disclosure contemplates a vacuum slide sheet feeder assembly 30, as shown in FIG. 4, which replace the sheet feeder 300 and associated components described above. The assembly 30 may be used in any machine, like the electrophotographic printing or reproduction machine M shown in FIG. 1, that requires retrieval of sheet material from a stack to be conveyed along a path within the machine. In the illustrate embodiment, the sheet feeder assembly 30 is used as a top vacuum corrugated feeder (TVCF) to remove a sheet S from a stack T (see FIG. 3).

Figure 6:
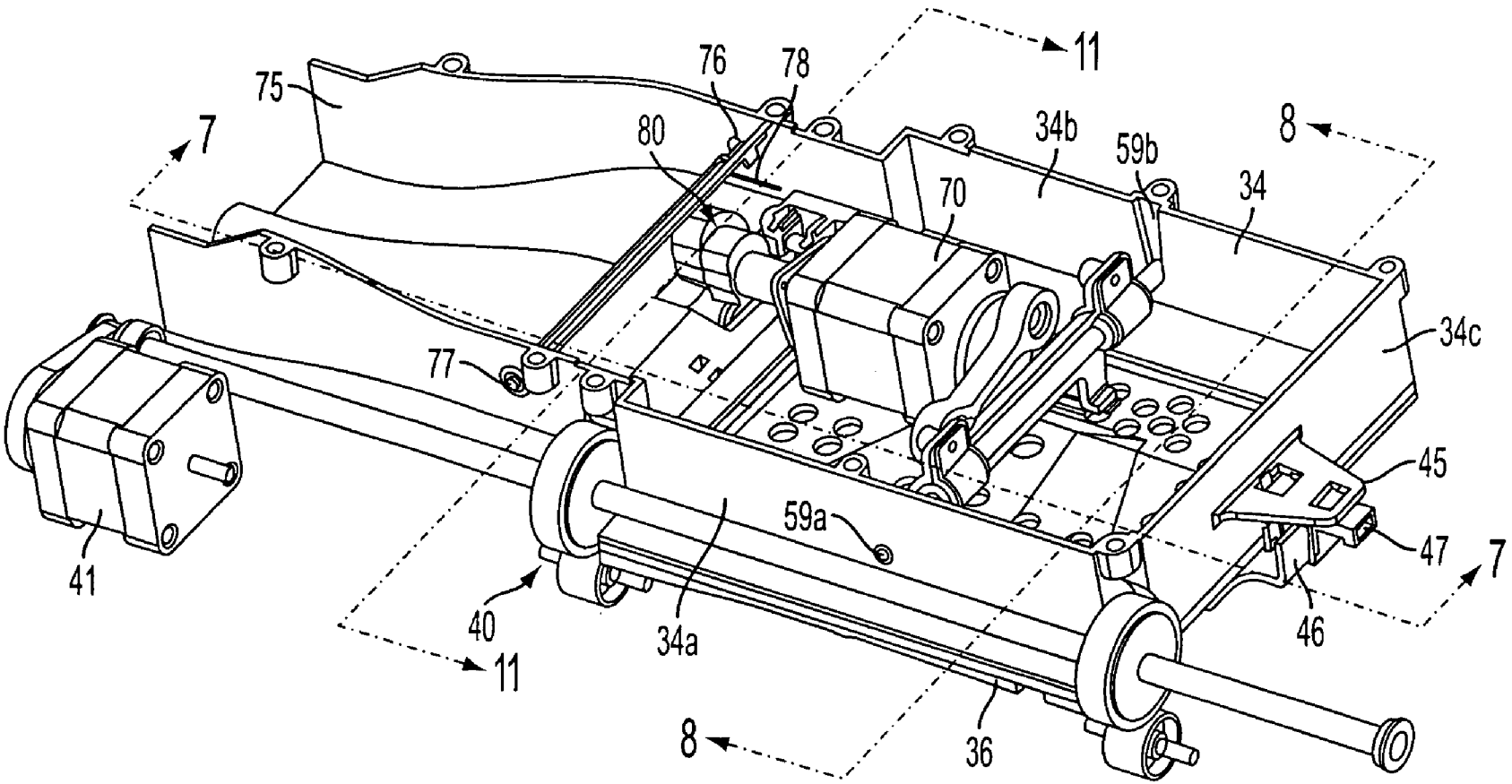
FIG. 6 is a top perspective view of the sheet feeder apparatus shown in FIG. 4, with certain components removed for clarity.

The feeder assembly 30 includes a frame 32 that supports the components of the assembly within the particular machine. Preferably, the frame is constructed so that the entire assembly 30 forms a discrete removable component for servicing or replacement. A plenum 34 is supported on the underside of a top plate 33 of the frame 32 in communication with a vacuum duct 75, as shown in FIGS. 4 and 6. The general perimeter of the plenum 34 is best seen in FIG. 6 in which the frame 32 and top plate 33 have been removed to expose the interior of the plenum. The duct 75 integrates with the vacuum source or air system of the machine that is adapted to draw a predetermined vacuum or negative pressure through the conduit. The magnitude of the negative pressure depends upon blower speed and upon the weight of the sheet S being conveyed by the sheet feeder assembly 30 in a manner that is known in the art. As will be appreciated from the following description, certain aspects of the assembly 30 allow the vacuum duct 75 to be larger in cross-sectional area than ducts connected to prior TVCF devices.

In prior TVCF devices, the entire device is transported to carry a sheet captured on the acquisition surface of the device. In accordance with one feature of the illustrated embodiment, the assembly 30 includes a slide plate 36 that closes the lower opening 35 of the plenum 34, as shown in FIGS. 4 and 6. The slide plate 36 includes an acquisition surface 37 that is arranged to face a sheet to be acquired and conveyed. The acquisition surface 37 defines a plurality of apertures 38 through which the vacuum or suction is applied to engage the sheet S. The number, size and arrangement of the apertures 38 may be as known in the art to efficiently corrugate and acquire various types of sheet material.

In one feature of the assembly 30, the slide plate 36 is supported on the plenum 34 so that only the slide plate translates. This feature is in stark contrast to prior TVCF devices in which the entire device translates. The slide plate 36 alone translates once the sheet S has been vacuum acquired. Thus, only the drive mechanism for conveying the sheet need only be powerful enough to move the lightweight slide plate 36 and sheet S. In one specific embodiment, the slide plate 36 is formed from a thin plate of molded plastic so that the weight of the plate is minimal.

Figure 8:
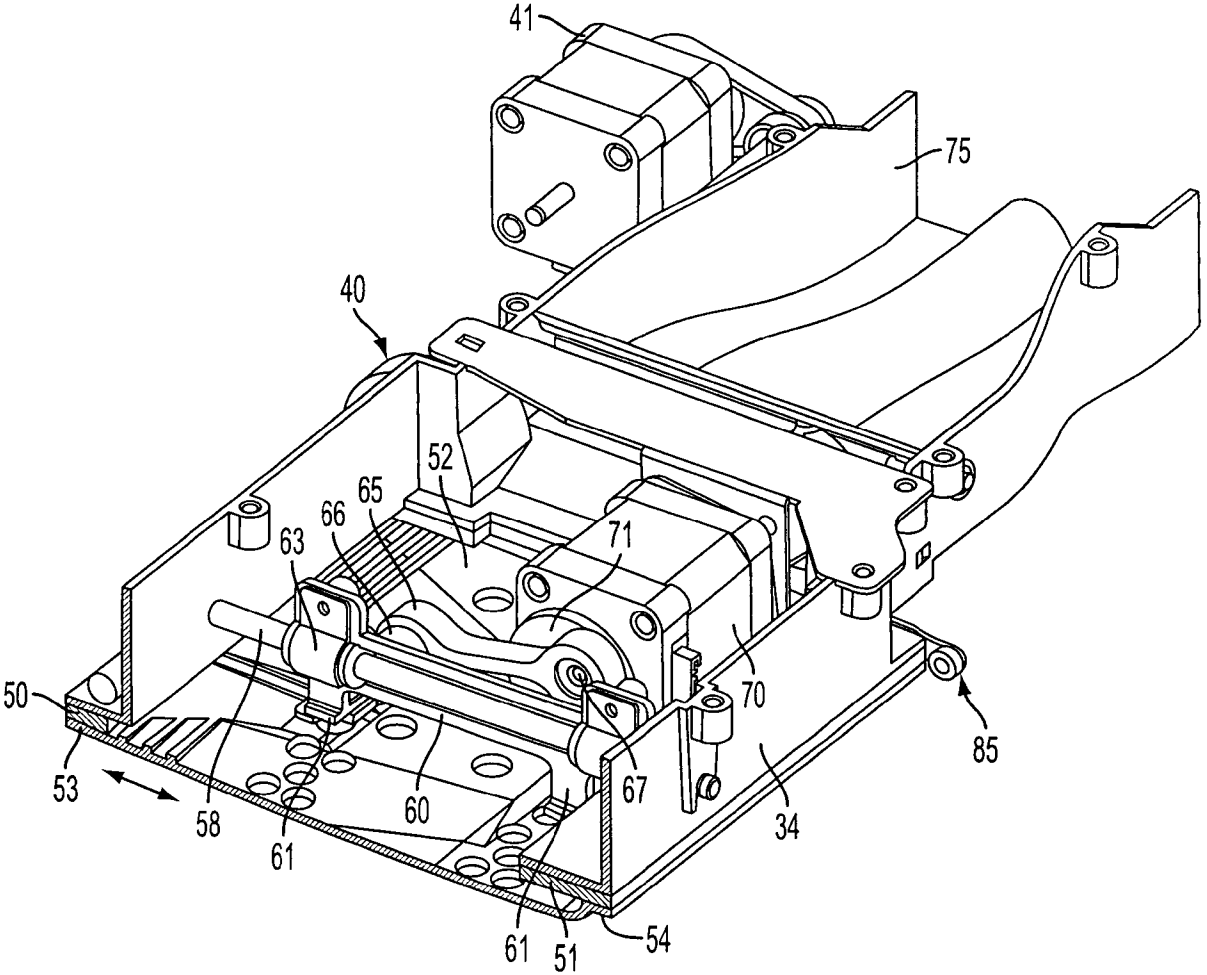
FIG. 8 is a perspective cut-away view of the assembly depicted in FIG. 6, taken along line 8-8 as viewed in the direction of the arrows.
Figure 9:
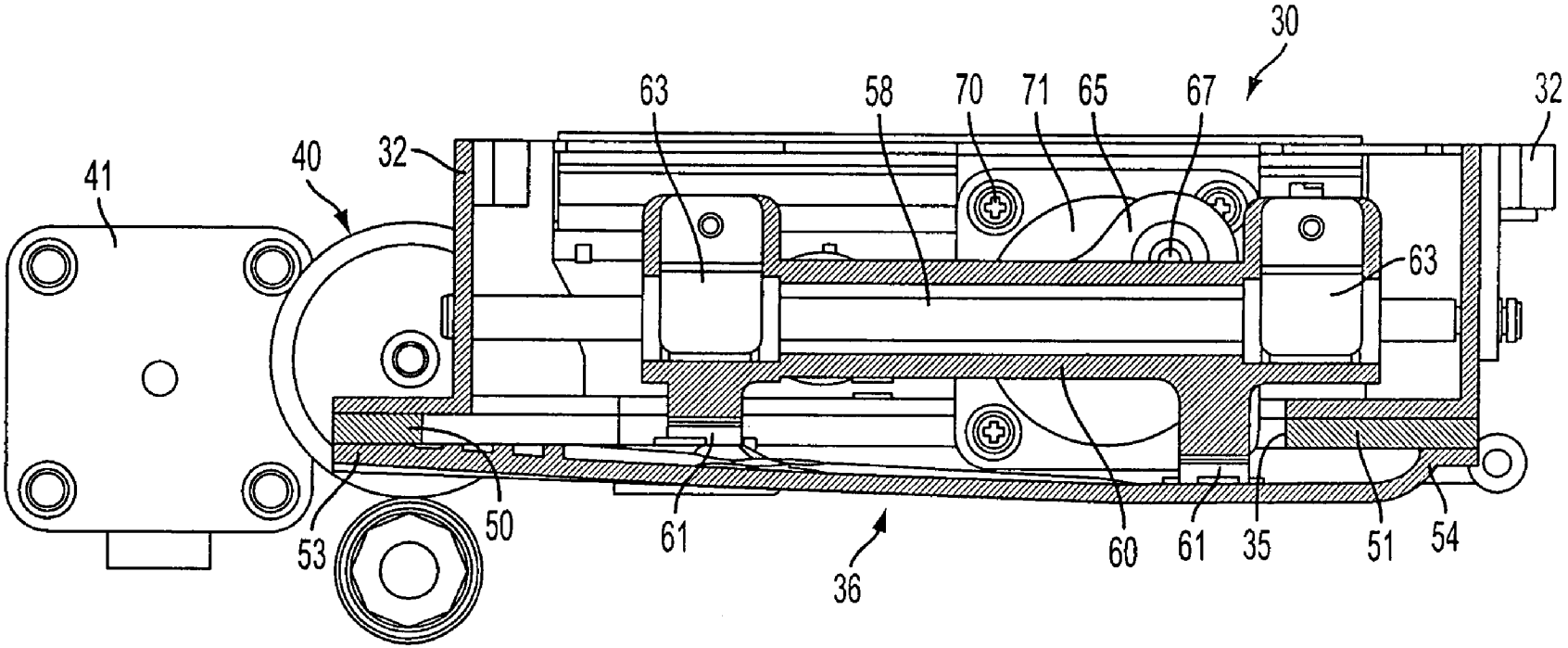
FIG. 9 is an end view of the cut-away shown in FIG. 8.

The plenum 34 includes a seal around its lower perimeter against which the slide plate 36 bears to maintain the proper vacuum within the plenum. Thus, in one embodiment, the plenum includes a front seal 50 and a rear seal 51, as shown in FIGS. 8-9, as well as side seals 52 (FIG. 8). The slide plate 36 is configured to contact each of the seals, including a front sealing flange 53 and a rear sealing flange 54 (FIGS. 8-9). The seals 50-53 may be formed together as one piece of a low sliding friction material, such as a low density closed-cell foam with an HDPE facing. In one specific embodiment, the front and rear seals 50, 51 and the front and rear sealing flanges 53, 54 are configured so that the slide plate maintains a sealing, but sliding, contact with the plenum throughout the entire length of travel of the slide plate. The travel distance of the plate 36 is determined by the location of the take-away rolls (TAR) 40, driven by motor 41, (FIGS. 4, 9) relative to the location of the stack T from which the sheet S is acquired. In one embodiment, the travel distance of the plate 36 is about 20 mm.

In an alternative embodiment, the relative dimensions of the rear seal 51 and the rear sealing flange 54 may be arranged so that the vacuum pressure is vented near the end of the forward travel of the slide plate 36. This venting feature is calibrated so that when the sheet S is engaged by the TAR 40 the sheet is essentially released from the slide plate. Thus, in a specific embodiment, if the forward travel distance of the slide plate is 20 mm, the contact or overlap region of between the rear sealing flange 54 and the rear seal 51 may be about 17 mm so that the vacuum pressure is vented over the last 3 mm of travel of the slide plate.

In another feature of the disclosed embodiment, the drive mechanism for translating the slide plate 36 is situated within the vacuum plenum 34, as seen in FIGS. 6-9. In particular, a drive motor 70 is mounted to a support plate 73 (FIG. 10) that is fastened to the plenum. The motor 70 rotates a drive wheel 71 which carries an eccentric pivot mount 67. A drive link 65 is fastened at the pivot mount 67 so that rotation of the drive wheel produces reciprocation of the drive link in a known manner. The drive link 65 is connected to a slide carriage 60, which is itself fastened to the slide plate 36 by way of engagement clips 61 or other suitable fasteners. The link 65 drives the carriage 60 which ultimately translates the slide plate as the eccentrically mounted drive link reciprocates. The slide carriage 60 is supported on a support member or shaft 58 that spans between the front and rear walls 34*a*, 34*b* of the plenum 34. In the illustrated embodiment, the slide carriage 60 includes a pair of linear bearings 63 that are mounted on the shaft 58 so that the bearings slide along the shaft as the drive link 65 causes the carriage to reciprocate. The shaft may be in the form of a stainless steel rod that has one end mounted within a bore 59*a* in the front wall 34*a* and an opposite end that may be dropped into an assembly slot 59 in the rear wall 34*b* of the plenum.

The slide plate 36 is reciprocated between its sheet acquisition position directly above the sheet stack T to its transfer position adjacent the TAR 40 by operation of the motor 70 and reciprocation of the drive link 65. The slide plate 36 is supported relative to the plenum 34 by the slide carriage 60. Contact between the slide plate 36 and the seals 50-52 help prevent rotation of the plate as it translates. In order to locate a "home" or start position for the slide plate 36, the slide plate may include a home flag 46 to actuate a home sensor 47 mounted in a molded tab 45 at one side of the plenum as shown in FIG. 6. Contact between the slide plate 36 and the seals 50-52 help prevent rotation of the plate as it translates.

It can be appreciated that mounting the slide plate drive mechanism within the plenum 34 reduces the overall envelope occupied by the sheet feeder assembly 30 within the machine M. In prior TVCF devices, the motor used to drive the device is positioned adjacent the vacuum duct, and in fact infringes on the duct area. With the present embodiment, placing the motor 70 within the plenum 70 means that the vacuum duct 75 is not compromised so that full vacuum flow may be drawn through the duct.

Figure 7:
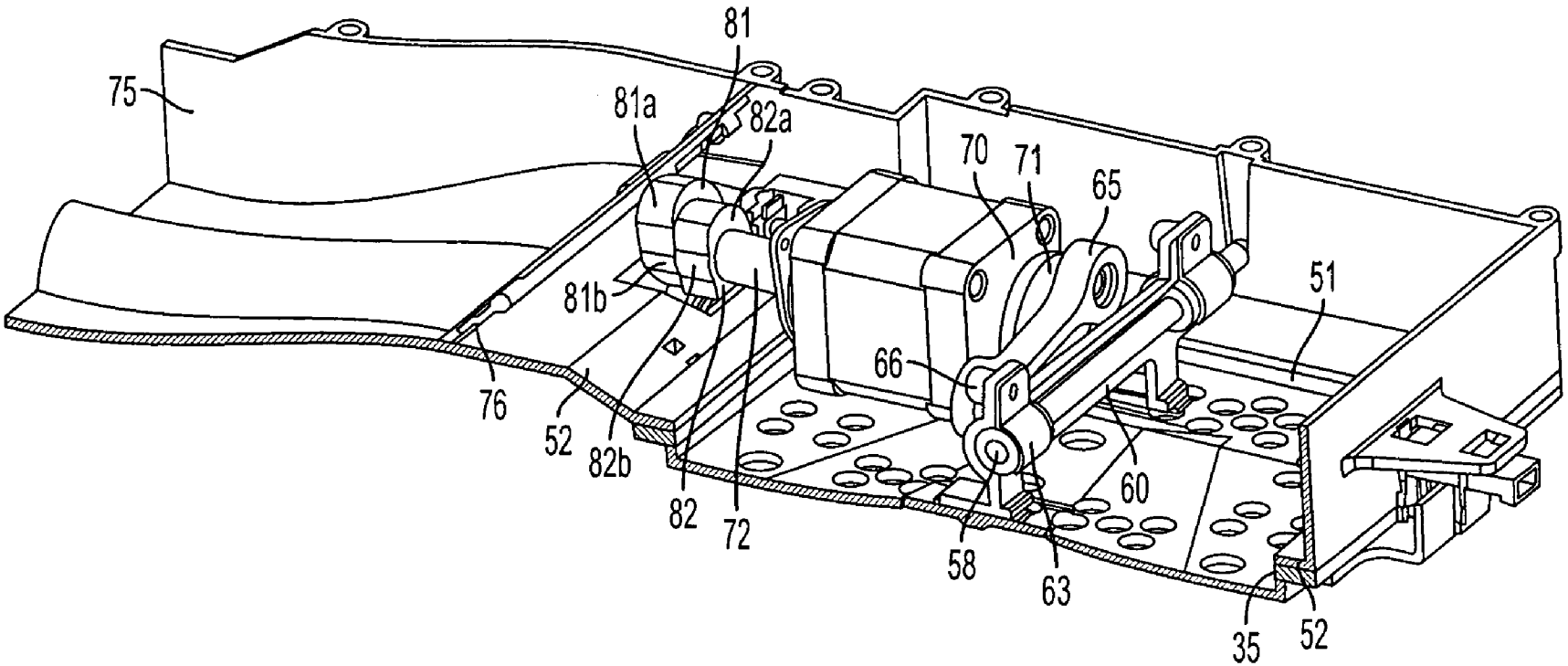
FIG. 7 is a perspective cut-away view of the assembly depicted in FIG. 6, taken along line 7-7 as viewed in the direction of the arrows.
Figure 10:
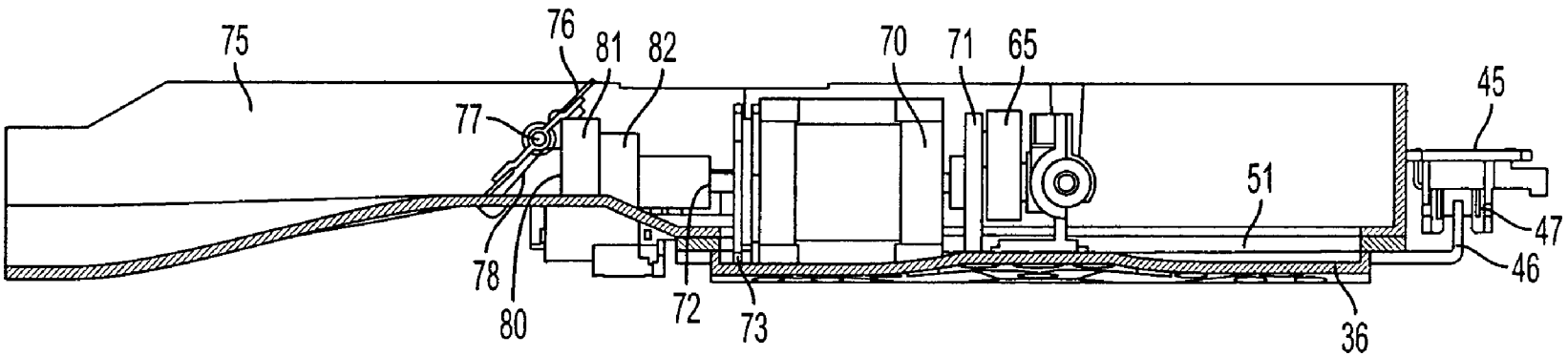
FIG. 10 is a side view of the cut-away shown in FIG. 7.

As is known in the art, the vacuum applied to the feeder assembly is controllable, at a minimum with respect to the amount of time that vacuum is drawn through the acquisition surface. Thus, the feeder assembly 30 provides means for controlling the vacuum drawn through the plenum 34 and slide plate 36. In particular, the assembly is provided with a flapper valve 76 that is disposed between the duct 75 and the plenum 34, as shown in FIGS. 6, 7 and 10. The valve 76 is pivotably mounted about an axle 77 that spans the side walls of the duct 75. A torsion spring 78 is preferably arranged to bias the flapper valve 76 to its open position in which the plenum 34 is open to the duct. The walls of the duct 75 may include features against which the flapper valve seats to ensure an acceptably tight seal between the duct and the plenum when the flapper valve is in its closed position, as depicted in FIG. 10.

As is also known in the art, a motor driven cam may be used to move the flapper valve from its biased open position to a closed position. Thus, the feeder assembly 30 of the present disclosure also includes a cam element 80 that is mounted to a drive axle 72 of the motor 70. The cam element 80 includes a flapper cam portion 81 that is arranged to contact the flapper valve 76. In particular, the flapper cam portion 81 includes a lobe 81*a* (see FIG. 7) that bears against the valve 76 to push against the torsion spring 77 and dislodge the valve from the sealing features within the duct 75. The cam portion also includes a flat 81*b* that is sized to avoid contact with the flapper valve. Thus, it can be appreciated that the arrangement of lobe and flat determines the open-close cycle for the flapper valve, and ultimately the timing of the vacuum at the acquisition surface 37 to acquire a sheet S from the stack T. Moreover, it is understood that the configuration of the lobe 81*a* determines the dwell period for the flapper valve so that the valve remains open as the sheet S is being conveyed by translation of the slide plate 36. The lobe is configured so that the flapper valve is closed once the sheet has reached the TAR 40.

In one feature of this embodiment, the cam 80 and flapper cam portion 81 are driven by the same motor 70 that drives the slide plate 36. As explained above, since the motor is not required to drive the entire feeder assembly 30 (as in prior devices), the entire power output from the motor need not be dedicated solely to moving the acquisition surface. In other words, the same motor used to drive the prior art feeder assembly 300 (FIG. 3) may drive not only the slide plate 36 but also the cam element 80. The timing of the slide plate movement is automatically and mechanically linked to the timing of the rotation of the flapper cam portion 81 since they are both driven off the drive axle 72 of the motor 70. Another benefit of the presently disclosed flapper valve is that the motor and cam are contained within the plenum 34, rather than outside the duct or plenum, thereby simplifying the overall structure and envelope of the feeder assembly 30.

Figure 5:
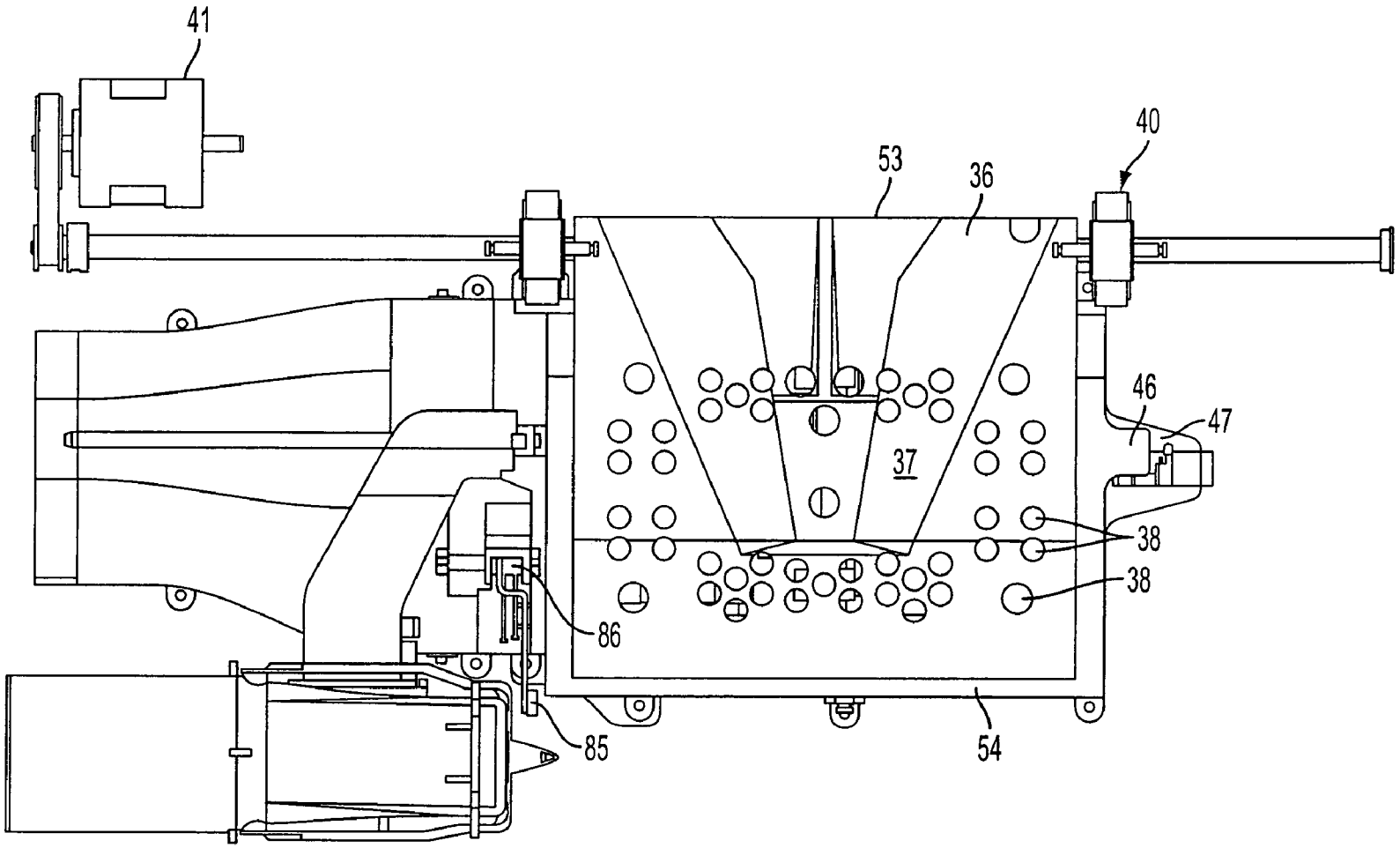
FIG. 5 is a bottom view of the sheet feeder apparatus shown in FIG. 4, with the assembly frame removed for clarity.
Figure 11:
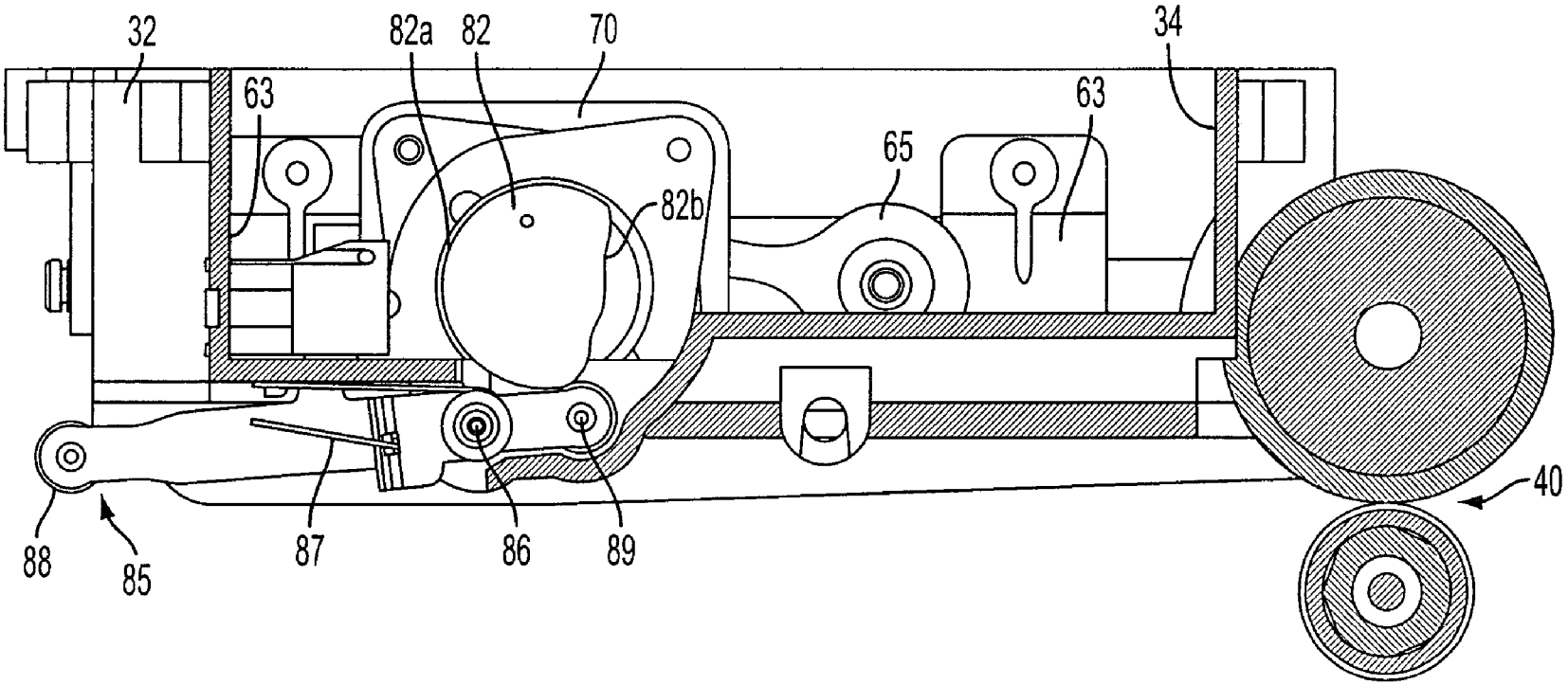
FIG. 11 is an end cut-away view of the assembly depicted in FIG. 6, taken along line 11-11 as viewed in the direction of the arrows.
Figure 12:
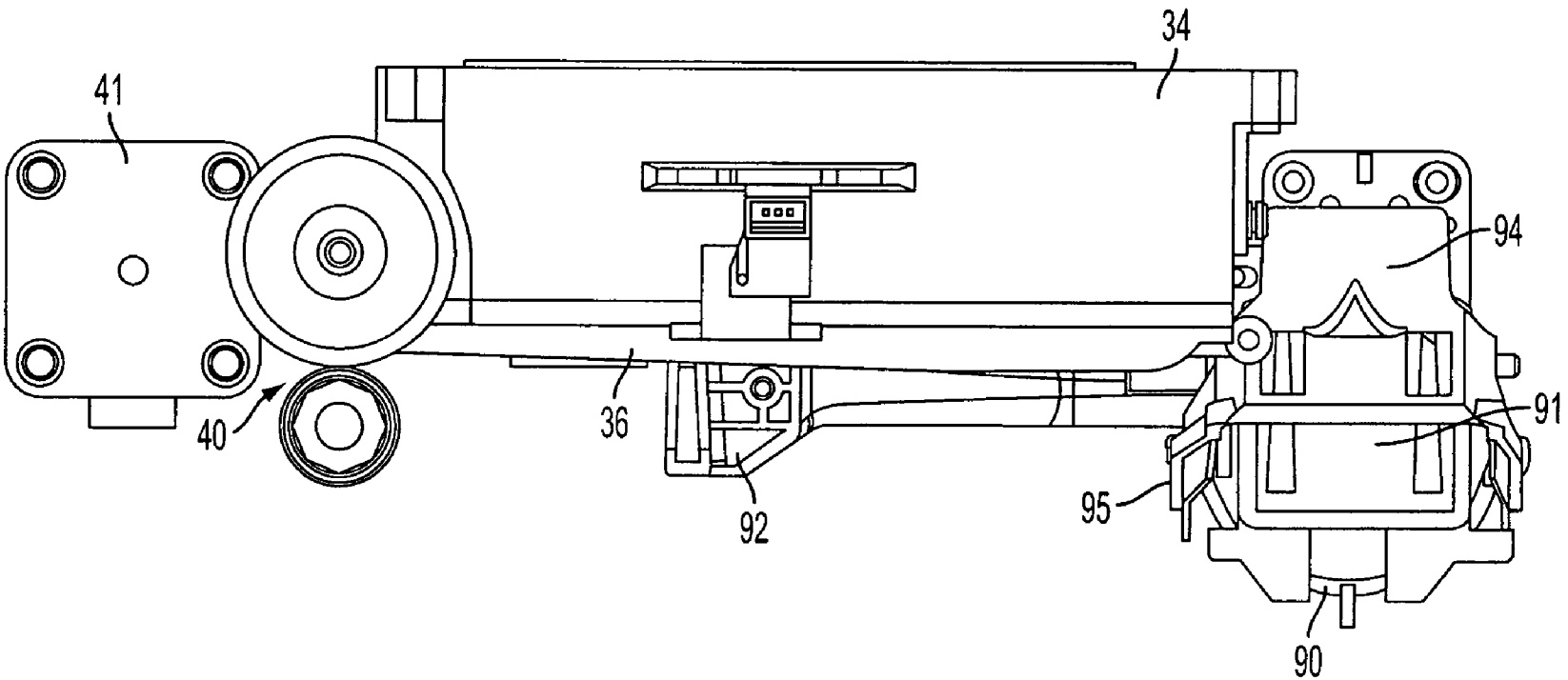
FIG. 12 is an end elevational view of the assembly illustrated in FIG. 4 with certain components removed for clarity.
Figure 13:
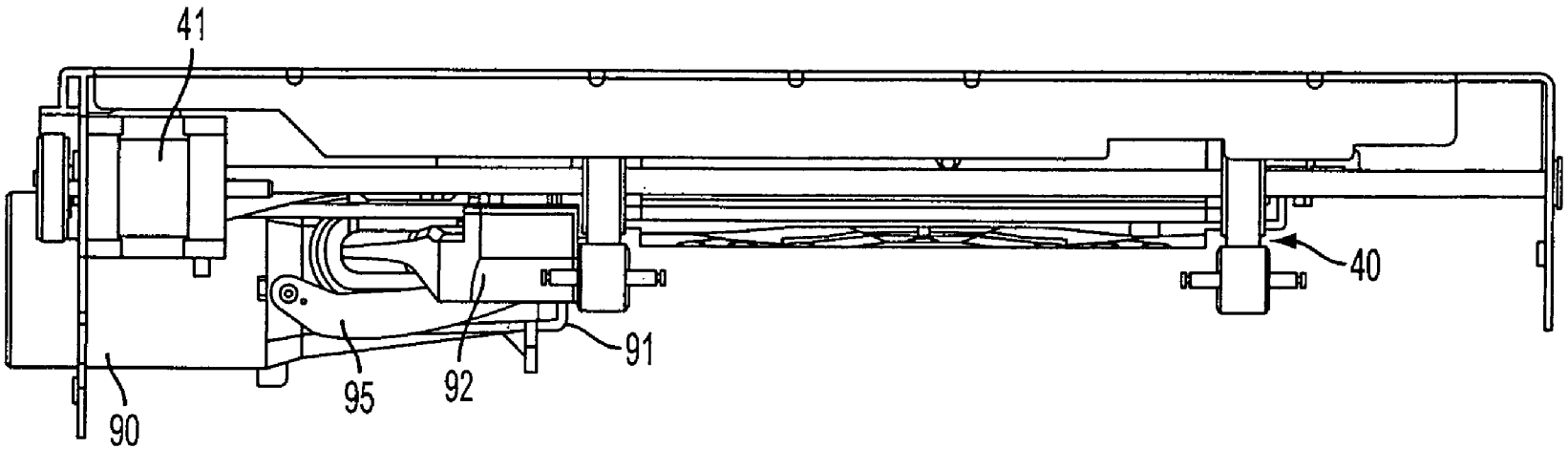
FIG. 13 is a front elevational view of the assembly depicted in FIG. 4 with certain components removed for clarity.

In addition to controlling the flapper valve 76, the same motor 70 that drives the acquisition surface may also be used to control the operation of a height sensing arm 85. It is known in prior machines to provide a mechanical height sensing arm that is retracted when a sheet is being acquired and conveyed to the take-away rolls and that is dropped into contact with the stack T to determine the height of the stack. The present assembly 30 includes a height sensing arm 85 that extends below the plenum 34 and slide plate 36, as shown in FIGS. 5, 8 and 11. The arm 85 includes a pivot mount 86 that may be situated between the duct 75 and the plenum 34 (FIG. 5). A biasing spring 87, such as a leaf spring, engages the height sensing arm 85 to bias the contact end 88 toward the stack (i.e., downward in FIG. 11).

As with the flapper valve, the operation of the height sensing arm 85 is controlled by a cam. In particular, the cam element 80 includes a sensing cam portion 82 that is arranged to contact a cam follower 89 forming part of the height sensing arm 85. The sensing cam portion 82 includes a lobe 82*a* and a flat 82*b* that control the movement of the follower 89, and ultimately the contact end 88 of the sensing arm 85. In particular, when the lobe 82*a* is in contact with the follower 89, the contact end 88 is elevated from the stack T. When the cam portion 82 is rotated further, the bias spring 87 biases the follower 89 into contact with the flat 82*b*, which allows the contact end 88 to contact the stack T.

Again, like the flapper valve control, control of the height sensing arm 85 is based on the operation of a common motor. The motor 70 thus controls three functions of the feeder assembly 30—movement of the acquisition surface 37 and the sheet S, movement of the flapper valve 76 and movement of the height sensing arm 85. Also, as with the flapper valve control, the movement of the height sensing arm is automatically and mechanically linked to the movement of the acquisition surface and slide plate because the same motor 70 is used. The configuration of the cam portion 82 fixes the timing of the lifting of the sensing arm 85 as the slide plate 36 acquires the sheet S and propels it toward the TAR 40, as well as the timing of the release of the sensing arm 85 to compress the stack and measure the stack height after the sheet has been released and the slide plate 36 is being withdrawn to its neutral position.

The feeder assembly 30 may include an arrangement of fluffer jets that are arranged to fluff the top sheet of a stack to facilitate acquisition by the slide plate. Thus, the frame 32 may support a fluffer plenum 90 that is connectable to an air supply, as shown in FIGS. 4, 5, 12 and 13. The plenum 90 terminates in a main fluffer jet 91 and may feed a leading edge fluffer 92 that is disposed closer to the leading edge of the sheet. A fluffer gate 94 is pivotably supported on the frame by a gate arm and is movable to open and close the main fluffer jet 91 in a known manner.

The feeder assembly 30 disclosed herein provides significant advantages over prior sheet feeder systems. As explained above, rather than translating the entire feeder assembly as in prior systems, the assembly 30 provides for translation of only the acquisition surface and the sheet carried by the surface. Thus, only the slide plate 36 and the carried sheet S is driven by the motor 70. In a specific embodiment, the slide plate has a transported mass of only about 100 gm, or about $1/5^{th}$ the transported mass of some prior feeder systems. This lower transport mass not only reduces the power requirements for the drive motor 70, it also translates into lower inertia and ultimately to quicker/faster transport of the acquisition surface and sheet S carried thereby. In the specific embodiment, the assembly 30 may be capable of sheet feed rates of up to 200 pages per minute, or even greater.

The reduced power requirements for transporting the acquisition surface and sheet may be manifested in a smaller motor, or more preferably in the integration of multiple functions from a common motor. Thus, as disclosed above, the motor 70 drives the slide plate 70 and rotates the cam element 80 that controls the movement of the flapper valve 76 and the height sensing arm 85. The motor power must be sufficient to overcome the biasing force generated by the torsion spring 78 restraining the flapper valve and the spring 87 biasing the height sensing arm. Combining several functions into the common package of the feeder assembly 30 can allow usage of the motor that had been used to drive prior vacuum valves to instead drive the take-away roll, especially in high speed applications.

The feeder assembly 30 provides a very compact and modular package for placement within the printing machine M. Since multiple functions are combined into a single package, the individual motors associated with prior feeder systems are eliminated. Moreover, the common drive motor allows repositioning of certain functional components within the plenum region that could not be achieved with prior systems. For instance, the height sensing arm 85 may be located closer to the feed head or acquisition surface, rather than near the trailing edge as in prior systems. This location for the height sensing arm improves the accuracy of location of the top of the fluffed stack relative to the acquisition surface, especially for long sheet length or for curled sheets.

Another benefit is that the working parts are wholly contained within the envelope of the vacuum plenum 34. Mounting the motor 70 within the plenum reduces the overall outer dimension of the entire assembly 30 and, as indicated above, frees up space of the vacuum duct 75. The larger available vacuum duct eliminates the feed head skirts in prior sheet acquisition systems that were necessary to overcome high vacuum system impedance. Since the slide plate 36 and cam element 80 are driven from a common motor, additional drive components are eliminated, such as cable drives and pulleys associated with prior feeder systems. The substantially direct drive between the motor 70 and the carriage 60 supporting the slide plate also eliminates the additional drive components of prior systems and reduces the mechanical losses associated therewith.

The motor 70 is preferably an electric motor, and may be a stepper motor capable of stepwise movement or rotation. Thus, the motor is capable of controlled rotation to coordinate the several functions of the feeder assembly 30. It is contemplated that the motor may be operated for continuous high-speed rotation without compromising the function of the drive link 65 and cam element 80.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A sheet feeder assembly for acquiring and conveying a sheet comprising:

a plenum connectable to a vacuum source and having an opening facing the sheet to be conveyed;

a slide plate covering said opening, said slide plate having an acquisition surface facing the sheet to be conveyed and having a plurality of apertures in communication with said plenum through which vacuum is drawn to acquire the sheet; and a drive mechanism connected to said slide plate and supported within said plenum, said drive mechanism operable to translate said slide plate relative to said plenum to convey the sheet acquired thereby.

2. The sheet feeder assembly of claim 1, wherein said drive mechanism includes:

a carriage supporting said slide plate;

a motor; and an eccentrically driven link rotatably connected between said motor and said carriage, whereby rotation of said link by said motor reciprocates said carriage relative thereto.

3. The sheet feeder assembly of claim 2, wherein said drive mechanism includes:

a support member mounted within said plenum; and said carriage includes at least one bearing configured to slidably support said carriage on said support member.

4. The sheet feeder assembly of claim 3, wherein said support member is a shaft supported between opposite walls of said plenum.

5. The sheet feeder assembly of claim 1, further comprising a sliding seal between said plenum and said slide plate.

6. The sheet feeder assembly of claim 5, wherein:

said plenum includes a front seal and a rear seal; and said slide plate includes a front sealing flange in sliding contact with said front seal and a rear sealing flange in sliding contact with said rear seal, wherein said front seal and said front sealing flange are sized to overlap each other and said rear seal and said rear sealing flange are sized to overlap each other to maintain a substantial vacuum seal therebetween throughout a range of translation of said slide plate relative to said plenum.

7. The sheet feeder assembly of claim 6, wherein said rear seal and said rear sealing flange are sized to not overlap each other so that the vacuum seal is broken when said slide plate translates past said range of translation relative to said plenum.

8. The sheet feeder assembly of claim 1, further comprising:

a vacuum duct connected between said plenum and the vacuum source; and a valve disposed between said duct and said plenum, and movable between an open position in which said duct is open to said plenum, and a closed position in which said duct is closed to said plenum.

9. The sheet feeder assembly of claim 8, wherein said valve is coupled to said drive mechanism so that operation of said drive mechanism moves said valve between said open and closed positions.

10. The sheet feeder assembly of claim 9, wherein said drive mechanism includes a motor coupled to simultaneously drive said slide plate and said valve.

11. The sheet feeder assembly of claim 10, wherein:

said valve is a flapper valve pivotably disposed between said vacuum duct and plenum and having a spring connected thereto for biasing said flapper valve to said closed position; and said drive mechanism includes a cam element rotatably driven by said motor, said cam element defining a valve cam portion with a lobe configured to contact said flapper valve to pivot said valve to said open position against the biasing of said spring and a flat configured to not contact said flapper valve.

12. The sheet feeder assembly of claim 9, further comprising a height sensing arm pivotably supported relative to said plenum, said height sensing arm having a sensing end arranged to contact the sheet in a contact position, said arm having a biasing spring connected thereto operable to bias said arm to said contact position.

13. The sheet feeder assembly of claim 12, wherein said height sensing arm is coupled to said drive mechanism so that operation of said drive mechanism moves said height sensing arm to and from said contact position.

14. The sheet feeder assembly of claim 13, wherein said valve and said height sensing arm are coupled to said motor through a cam element rotatably driven by said motor, said cam element having a valve cam portion in contact with said valve and a sensing arm cam portion in contact with said height sensing arm.

15. The sheet feeder assembly of claim 1, further comprising:

a frame supporting said plenum; and a take away roll (TAR) rotatably supported on said frame and arranged to receive a sheet conveyed by said slide plate.

16. The sheet feeder assembly of claim 15, wherein said TAR includes a motor separate from said drive mechanism.

17. A sheet feeder assembly for acquiring and conveying a sheet comprising:

a vacuum duct connectable to a vacuum source;

a plenum connected to said vacuum duct and having an opening facing the sheet to be conveyed;

a motor supported within said plenum;

a plate movably covering said opening, said plate having an acquisition surface facing the sheet to be conveyed and having a plurality of apertures in communication with said plenum through which vacuum is drawn to acquire the sheet;

a valve disposed between said duct and said plenum, and movable between an open position in which said duct is open to said plenum, and a closed position in which said duct is closed to said plenum; and a height sensing arm movably supported relative to said plenum, said height sensing arm having a sensing end arranged to contact the sheet in a contact position;

wherein said plate, said valve and said height sensing arm are operably coupled to said motor within said plenum so that operation of said motor moves each of said plate, said valve and said height sensing arm.

18. The sheet feeder assembly of claim 17, wherein said motor is a stepper motor.

19. The sheet feeder assembly of claim 17, wherein said plate is operably coupled to said motor by an eccentrically driven link.

20. The sheet feeder assembly of claim 17, wherein said valve and said sensing arm are operably coupled to said motor by a common cam element.

21. A printing machine comprising:

an imaging station for obtaining an image;

a transfer station for transferring the image onto a sheet;

a support tray for support a stack of sheets;

a transport system for transporting a sheet from said stack to said transfer station, said transport system including a top vacuum corrugation feeder assembly (TVCF) including;

a plenum connectable to a vacuum source and having an opening facing the stack on said support tray;

a slide plate covering said opening, said slide plate having an acquisition surface facing the stack on said support tray and having a plurality of apertures in communication with said plenum through which vacuum is drawn to acquire a sheet from the stack; and a drive mechanism connected to said slide plate and supported within said plenum, said drive mechanism operable to translate said slide plate relative to said plenum to convey the sheet acquired thereby.

22. The printing machine of claim 21, wherein said drive mechanism includes:

a carriage supporting said slide plate;

a motor; and an eccentrically driven link rotatably connected between said motor and said carriage, whereby rotation of said link by said motor reciprocates said carriage relative thereto.

23. The printing machine of claim 22, wherein said transport system further includes:

a vacuum duct connected between said plenum and the vacuum source; and a valve disposed between said duct and said plenum, and movable between an open position in which said duct is open to said plenum, and a closed position in which said duct is closed to said plenum, said valve operably coupled to said motor so that operation of said drive mechanism moves said valve between said open and closed positions.

24. The printing machine of claim 23, wherein said transport system further includes a height sensing arm pivotably supported relative to said plenum, said height sensing arm having a sensing end arranged to contact the stack in a contact position, said height sensing arm operably coupled to said motor so that operation of said motor moves said height sensing arm.

* * * * *